US012365963B2

(12) United States Patent
Laws et al.

(10) Patent No.: US 12,365,963 B2
(45) Date of Patent: Jul. 22, 2025

(54) COPPER ALLOYS

(71) Applicant: ADVANCED ALLOY HOLDINGS PTY LTD, Freshwater (AU)

(72) Inventors: Kevin James Laws, Freshwater (AU); Peter Tyrrell Nicholson, Freshwater (AU); Patrick Lars Joseph Conway, Freshwater (AU); Lori Cheryl Bassman, Freshwater (AU); Warren Richard McKenzie, Freshwater (AU)

(73) Assignee: ADVANCED ALLOY HOLDINGS PTY LTD, Freshwater (AU)

( * ) Notice: Subject to any disclaimer, the term of this patent is extended or adjusted under 35 U.S.C. 154(b) by 0 days.

(21) Appl. No.: 17/765,490

(22) PCT Filed: Oct. 2, 2020

(86) PCT No.: PCT/AU2020/051062

§ 371 (c)(1),
(2) Date: Mar. 31, 2022

(87) PCT Pub. No.: WO2021/062485

PCT Pub. Date: Apr. 8, 2021

(65) Prior Publication Data

US 2022/0372596 A1 Nov. 24, 2022

(30) Foreign Application Priority Data

Oct. 3, 2019 (AU) ..... 2019903725

(51) Int. Cl.

| | |
|---|---|
| ***C22C 9/05*** | (2006.01) |
| ***C22C 30/02*** | (2006.01) |
| ***C22C 30/06*** | (2006.01) |

(52) U.S. Cl.
CPC ..... *C22C 9/05* (2013.01); *C22C 30/02* (2013.01); *C22C 30/06* (2013.01)

(58) Field of Classification Search
None
See application file for complete search history.

(56) References Cited

U.S. PATENT DOCUMENTS 4,525,434 A * 6/1985 Morikawa ..... C22C 9/04 428/929
4,587,097 A 5/1986 Rabinkin et al.
(Continued)

FOREIGN PATENT DOCUMENTS

CN 1948531 4/2007
CN 1948531 A * 4/2007
(Continued)

OTHER PUBLICATIONS

English language machine translation of CN-1948531-A to Guo. Generated Feb. 23, 2023. (Year: 2023).*
(Continued)

*Primary Examiner* — Brian D Walck
(74) *Attorney, Agent, or Firm* — NORTON ROSE FULBRIGHT US LLP

(57) ABSTRACT

An alloy comprising or consisting of 40 to 62.5 atomic percent copper, 5 to 40 atomic percent manganese, up to 24 atomic percent nickel, 5 to 24 atomic percent zinc, and 1 to 15 atomic percent aluminium.

17 Claims, 3 Drawing Sheets

(56) References Cited

U.S. PATENT DOCUMENTS

| | | | | |
|---|---|---|---|---|
| 2011/0165013 | A1* | 7/2011 | Trybus | C22C 9/01 420/479 |
| 2013/0140066 | A1 | 6/2013 | Okuno et al. | |
| 2017/0349975 | A1* | 12/2017 | Laws | C22F 1/16 |

FOREIGN PATENT DOCUMENTS

| | | | |
|---|---|---|---|
| CN | 101012522 | | 8/2007 |
| CN | 109385610 | | 2/2019 |
| DE | 102012014851 | | 3/2013 |
| GB | 1272737 | | 5/1972 |
| JP | 55141540 | A * | 11/1980 |
| JP | S 55141540 | | 11/1980 |
| JP | 59-52223 | | 12/1984 |
| JP | 2013120411 | | 6/2013 |

OTHER PUBLICATIONS

English language machine translation of JP-55141540-A. Generated May 3, 2024. (Year: 2024).*

International Search Report and Written Opinion issued in Corresponding PCT Application No. PCT/AU2020/051062, dated Nov. 25, 2020.

Kansky et al., "Quaternary Diffusion in the Cu—Ni—Zn—Mn System at 775° C." *Metallurgical Transactions A*, 1985, vol. 16A, pp. 1123-1132 p. 1124, table 1.

Office Action issued in corresponding CN Application No. CN 202080076604.8, dated Feb. 18, 2023. (English Translation Provided).

Office Action Supplement issued in corresponding CN Application No. CN 202080076604.8. (English Translation Provided).

Extended European Search Report issued in corresponding EP Application No. EP 20872396.5, dated Apr. 4, 2023.

Masaki Morikawa, Piping Engineering, vol. 27, Issue 4, pp. 112-114, 131.

Wu X. X. et al., "Effect of stacking fault energy on mechanical behavior of cold-forging Cu and Cu alloys," Materials and Design 47 (2013) 372-376.

Ritchie R. O., "The conflicts between strength and toughness," Nature Materials, vol. 10, Nov. 2011, pp. 817-822.

Laws K. J. et al., "High entropy brasses and bronzes—Microstructure, phase evolution, and properties," Journal of Alloys and Compounds 650 (2015) 949-961.

Campbell F.C., ed., "Phase Diagrams—Understanding the Basics," ASM International, 2012, Ch1:pp. 1-9; 11.

Hillert M., "Phase Equilibria, Phase Diagrams and Phase Transformations," Cambridge University Press, New York, 2nd Edition, 2008, pp. 75-76; 166; 365-367.

Mittemeijer E. J., "Fundamentals of Materials Science; The Microstructure—Property Relationship Using Metals as Model Systems," 2nd Ed. Pub:Springer Nature Switzerland AG 2011, 2021, pp. 100-103; 148-169; 365-398; 688-690.

Hull D. and Bacon D. J., "Introduction to Dislocations," 5$^{th}$ Edition, Pub: Butterworth-Heinemann 2011; pp. 85-93 and 232-245.

Li Z. et al., "Mechanical properties of high-entropy alloys with emphasis on face-centered cubic alloys," Progress in Materials Science 2019, 102, pp. 296-345.

Okamoto H., Schlesinger M.E., and Mueller E.M., Eds., "Cu (Copper) Binary Alloy Phase Diagrams," ASM Handbook, vol. 3: Alloy Phase Diagrams, Pub: ASM International 2016, pp. 304-326.

Davis J.R., "Copper and Copper Alloys," Pub: ASM International, 2001, pp. 7; 39-45; 267.

Sun W. et al., "Experimental investigation and thermodynamic modelling of the Cu—Mn—Ni system," CALPHAD: Computer Coupling of Phase Diagrams and Thermochemistry 33 (2009) 642-649.

Alan Prince, K.C. Hari Kumar and MSIT ® (2004) G. Effenberg (ed.) MSI Eureka in SpringerMaterials "Al—Cu—Ni Ternary Phase Diagram Evaluation", 38 pages.

D. Matusch, J. Gröbner, V. Turkevich and MSIT ® (2006) G. Effenberg (ed.) MSI Eureka in SpringerMaterials "Cu—Mn—Zn Ternary Phase Diagram Evaluation," 18 pages.

G. Ghosh and J. Van Humbeeck, P. Perrot and MSIT ® (2004) G. Effenberg (ed.) MSI Eureka in SpringerMaterials "Al—Cu—Zn Ternary Phase Diagram Evaluation," 36 pages.

An X.H. et al., "The influence of stacking fault energy on the mechanical properties of nanostructured Cu and Cu—Al alloys processed by high-pressure torsion," Scripta Materialia, vol. 64, 2011, pp. 954-957.

Zhao Y.H. et al., "Evolution of defect structures during cold rolling of ultrafine-grained Cu and Cu—Zn alloys: Influence of stacking fault energy," Materials Science and Engineering: A, vol. 474, 2008 pp. 342-347.

* cited by examiner

COPPER ALLOYS

CROSS-REFERENCE TO RELATED APPLICATIONS

This application is a national phase application under 35 U.S.C. § 371 of International Application No. PCT/AU2020/051062, filed Oct. 2, 2020, which claims priority to and the benefit of Australian Application No. 2019903725, filed Oct. 3, 2019. The contents of the aforementioned patent applications are incorporated into the present application by reference.

FIELD OF THE DISCLOSURE

The present invention relates generally to alloys, and in particular, to copper alloys.

BACKGROUND OF THE DISCLOSURE

Any discussion of the prior art throughout this specification should in no way be considered as an admission that such prior art is widely known or forms part of the common general knowledge in the field.

Copper-nickel alloys have a range of uses including in heat extractors and radiators where good thermal conductivity is desirable, and in marine settings where corrosion resistance is desirable. However, such alloys can be expensive to manufacture and difficult to work. In this context, there is a need for new alloys having improved mechanical properties. It would also be advantageous to reduce certain costs associated with manufacturing alloys.

SUMMARY OF THE DISCLOSURE

In a first aspect, the present disclosure provides an alloy comprising or consisting of: 40 to 62.5 atomic percent copper; 5 to 40 atomic percent manganese; up to 24 atomic percent nickel; 5 to 24 atomic percent zinc; and 1 to 15 atomic percent aluminium.

In some examples, the alloy comprises or consists of: 40 to 62.5 atomic percent copper; 5 to 40 atomic percent manganese; 1 to 24 atomic percent nickel; 5 to 24 atomic percent zinc; and 1 to 15 atomic percent aluminium.

In some examples, the alloy comprises or consists of: 40 to 62.5 atomic percent copper; 8 to 40 atomic percent manganese; 1 to 24 atomic percent nickel; 5 to 24 atomic percent zinc; and 1 to 15 atomic percent aluminium.

In some examples, the alloy comprises or consists of: 40 to 62.5 atomic percent copper; 8 to 40 atomic percent manganese; 1 to 8 atomic percent nickel; 5 to 24 atomic percent zinc; and 1 to 15 atomic percent aluminium.

In some examples, the alloy comprises or consists of: 40 to 62.5 atomic percent copper; 8 to 40 atomic percent manganese; 1 to 8 atomic percent nickel; 5 to 24 atomic percent zinc; and 1 to 8 atomic percent aluminium.

In some examples, the alloy comprises or consists of: 40 to 62.5 atomic percent copper; 8 to 40 atomic percent manganese; 1 to 8 atomic percent nickel; 5 to 24 atomic percent zinc; and 1 to 5 atomic percent aluminium.

In some examples, the alloy comprises or consists of: 45 to 62.5 atomic percent copper; 8 to 40 atomic percent manganese; 1 to 8 atomic percent nickel; 5 to 24 atomic percent zinc; and 1 to 5 atomic percent aluminium.

In some examples, the alloy comprises or consists of: 45 to 60 atomic percent copper; 8 to 40 atomic percent manganese; 1 to 8 atomic percent nickel; 5 to 24 atomic percent zinc; and 1 to 5 atomic percent aluminium.

In some examples, the alloy comprises or consists of: 45 to 60 atomic percent copper; 12.5 to 40 atomic percent manganese; 1 to 8 atomic percent nickel; 5 to 24 atomic percent zinc; and 1 to 5 atomic percent aluminium.

In some examples, the alloy comprises or consists of: 45 to 60 atomic percent copper; 12.5 to 35 atomic percent manganese; 1 to 8 atomic percent nickel; 5 to 24 atomic percent zinc; and 1 to 5 atomic percent aluminium.

In some examples, the alloy comprises or consists of: 45 to 60 atomic percent copper; 12.5 to 35 atomic percent manganese; 1 to 7 atomic percent nickel; 5 to 24 atomic percent zinc; and 1 to 5 atomic percent aluminium.

In some examples, the alloy comprises or consists of: 45 to 60 atomic percent copper; 12.5 to 35 atomic percent manganese; 1 to 7 atomic percent nickel; 7.5 to 24 atomic percent zinc; and 1 to 5 atomic percent aluminium.

In some examples, the alloy comprises or consists of: 45 to 60 atomic percent copper; 12.5 to 35 atomic percent manganese; 1 to 7 atomic percent nickel; 7.5 to 20 atomic percent zinc; and 1 to 5 atomic percent aluminium.

In some examples, the alloy comprises or consists of: 45 to 60 atomic percent copper; 12.5 to 35 atomic percent manganese; 3 to 5 atomic percent nickel; 12.5 to 20 atomic percent zinc; and 1 to 3 atomic percent aluminium.

In some examples, the alloy comprises or consists of: 50 to 60 atomic percent copper; 12.5 to 35 atomic percent manganese; 1 to 7 atomic percent nickel; 7.5 to 20 atomic percent zinc; and 1 to 5 atomic percent aluminium.

In some examples, the alloy comprises or consists of: 50 to 60 atomic percent copper; 15 to 35 atomic percent manganese; 1 to 7 atomic percent nickel; 7.5 to 20 atomic percent zinc; and 1 to 5 atomic percent aluminium.

In some examples, the alloy comprises or consists of: 50 to 60 atomic percent copper; 15 to 22.5 atomic percent manganese; 1 to 7 atomic percent nickel; 7.5 to 20 atomic percent zinc; and 1 to 5 atomic percent aluminium.

In some examples, the alloy comprises or consists of: 50 to 60 atomic percent copper; 15 to 22.5 atomic percent manganese; 1 to 5 atomic percent nickel; 7.5 to 20 atomic percent zinc; and 1 to 5 atomic percent aluminium.

In some examples, the alloy comprises or consists of: 50 to 60 atomic percent copper; 15 to 22.5 atomic percent manganese; 1 to 5 atomic percent nickel; 15 to 20 atomic percent zinc; and 1 to 5 atomic percent aluminium.

In some examples, the alloy comprises or consists of: 50 to 60 atomic percent copper; 15 to 22.5 atomic percent manganese; 1 to 5 atomic percent nickel; 15 to 20 atomic percent zinc; and 1 to 3 atomic percent aluminium.

In some examples, the alloy comprises or consists of: 50 to 60 atomic percent copper; 22.5 to 35 atomic percent manganese; 1 to 5 atomic percent nickel; 5 to 12.5 atomic percent zinc; and 1 to 3 atomic percent aluminium.

In some examples, the alloy comprises or consists of: 50 to 60 atomic percent copper; 22.5 to 35 atomic percent manganese; 1 to 5 atomic percent nickel; 7.5 to 12.5 atomic percent zinc; and 1 to 3 atomic percent aluminium.

In some examples, the alloy comprises or consists of: 40 to 62.5 atomic percent copper; 17 to 35 atomic percent manganese; 1 to 7 atomic percent nickel; 10 to 24 atomic percent zinc; and 1 to 5 atomic percent aluminium.

In some examples, the alloy comprises or consists of: 45 to 60 atomic percent copper; 17 to 35 atomic percent manganese; 1 to 5 atomic percent nickel; 10 to 20 atomic percent zinc; and 1 to 5 atomic percent aluminium.

In some examples, the alloy comprises or consists of: 50 to 60 atomic percent copper; 17 to 35 atomic percent manganese; 1 to 5 atomic percent nickel; 10 to 20 atomic percent zinc; and 1 to 5 atomic percent aluminium.

In some examples, (3× atomic percent of aluminium)+atomic percent of zinc+(0.2× atomic percent of manganese) is between 22.5% and 32.5%.

In some examples, the atomic percent ratio of copper: nickel is at least 9.

In some examples, the alloy has a tensile strain to failure of between about 40% and 65%.

In some examples, the alloy has an ultimate tensile strength of between about 390 MPa and 575 MPa.

In some examples, the alloy has an as-cast hardness ($H_V$) of between about 80 and 170.

In a second aspect, the present disclosure provides an alloy comprising or consisting of: 40 to 62.5 atomic percent copper; 5 to 40 atomic percent manganese; up to 24 atomic percent nickel; 5 to 24 atomic percent zinc; 1 to 15 atomic percent aluminium; up to 20 atomic percent of one or more elements selected from the group consisting of chromium, lead, bismuth, cobalt, iron, carbon, tin, silicon and magnesium; and up to 1 atomic percent of one or more elements selected from the group consisting of arsenic, phosphorus, sulphur and antimony.

In some examples, the alloy comprises or consists of: 40 to 62.5 atomic percent copper; 5 to 40 atomic percent manganese; up to 24 atomic percent nickel; 5 to 24 atomic percent zinc; 1 to 15 atomic percent aluminium; up to 12 atomic percent of one or more elements selected from the group consisting of chromium, lead, bismuth, cobalt, iron, carbon, tin, silicon and magnesium; and up to 1 atomic percent of one or more elements selected from the group consisting of arsenic, phosphorus, sulphur and antimony.

In some examples, the alloy comprises or consists of: 40 to 62.5 atomic percent copper; 5 to 40 atomic percent manganese; up to 24 atomic percent nickel; 5 to 24 atomic percent zinc; 1 to 15 atomic percent aluminium; up to 12 atomic percent of chromium, lead, bismuth, cobalt, iron, carbon, tin, silicon or magnesium; and up to 1 atomic percent of one or more elements selected from the group consisting of arsenic, phosphorus, sulphur and antimony.

In some examples, the alloy comprises or consists of: 40 to 62.5 atomic percent copper; 5 to 40 atomic percent manganese; up to 24 atomic percent nickel; 5 to 24 atomic percent zinc; 1 to 15 atomic percent aluminium; up to 7 atomic percent chromium; up to 8 atomic percent lead; up to 8 atomic percent bismuth; up to 8 atomic percent cobalt; up to 12 atomic percent iron; up to 8 atomic percent carbon; up to 8 atomic percent tin; up to 8 atomic percent silicon; up to 2 atomic percent magnesium; up to 0.5 atomic percent arsenic; up to 0.5 atomic percent phosphorus; up to 0.5 atomic percent sulphur; and up to 0.5 atomic percent antimony.

In some examples, the alloy comprises or consists of: 40 to 62.5 atomic percent copper; 5 to 40 atomic percent manganese; up to 24 atomic percent nickel; 5 to 24 atomic percent zinc; 1 to 15 atomic percent aluminium; up to 5 atomic percent chromium; up to 5 atomic percent lead; up to 2 atomic percent bismuth; up to 8 atomic percent cobalt; up to 12 atomic percent iron; up to 4 atomic percent carbon; up to 2 atomic percent tin; up to 8 atomic percent silicon; up to 2 atomic percent magnesium; up to 0.3 atomic percent arsenic; up to 0.3 atomic percent phosphorus; up to 0.3 atomic percent sulphur; and up to 0.3 atomic percent antimony.

In some examples, the alloy comprises or consists of: 85 to 95 atomic percent copper, manganese, nickel, zinc and aluminium; and balance of one or more elements selected from the group consisting of chromium, lead, bismuth, cobalt, iron, carbon, tin and silicon.

In some examples, the alloy comprises or consists of: 40 to 62.5 atomic percent copper; 17 to 35 atomic percent manganese; 1 to 7 atomic percent nickel; 10 to 24 atomic percent zinc; 1 to 5 atomic percent aluminium; up to 20 atomic percent of one or more elements selected from the group consisting of chromium, lead, bismuth, cobalt, iron, carbon, tin, silicon and magnesium; and up to 1 atomic percent of one or more elements selected from the group consisting of arsenic, phosphorus, sulphur and antimony.

In some examples, the alloy comprises or consists of: 45 to 60 atomic percent copper; 17 to 35 atomic percent manganese; 1 to 5 atomic percent nickel; 10 to 20 atomic percent zinc; 1 to 5 atomic percent aluminium; up to 20 atomic percent of one or more elements selected from the group consisting of chromium, lead, bismuth, cobalt, iron, carbon, tin, silicon and magnesium; and up to 1 atomic percent of one or more elements selected from the group consisting of arsenic, phosphorus, sulphur and antimony.

In some examples, the alloy comprises or consists of: 50 to 60 atomic percent copper; 17 to 35 atomic percent manganese; 1 to 5 atomic percent nickel; 10 to 20 atomic percent zinc; 1 to 5 atomic percent aluminium; up to 20 atomic percent of one or more elements selected from the group consisting of chromium, lead, bismuth, cobalt, iron, carbon, tin, silicon and magnesium; and up to 1 atomic percent of one or more elements selected from the group consisting of arsenic, phosphorus, sulphur and antimony.

In some examples, (3× atomic percent of aluminium)+atomic percent of zinc+(0.2× atomic percent of manganese) is between 22.5% and 32.5%.

In some examples, the atomic percent ratio of copper: nickel is at least 9.

In some examples, the alloy has a tensile strain to failure of between about 30% and 65%.

In some examples, the alloy has an ultimate tensile strength of between about 390 MPa and 575 MPa.

In some examples, the alloy has an as-cast hardness ($H_V$) of between about 80 and 170.

DETAILED DESCRIPTION

Figure 1:
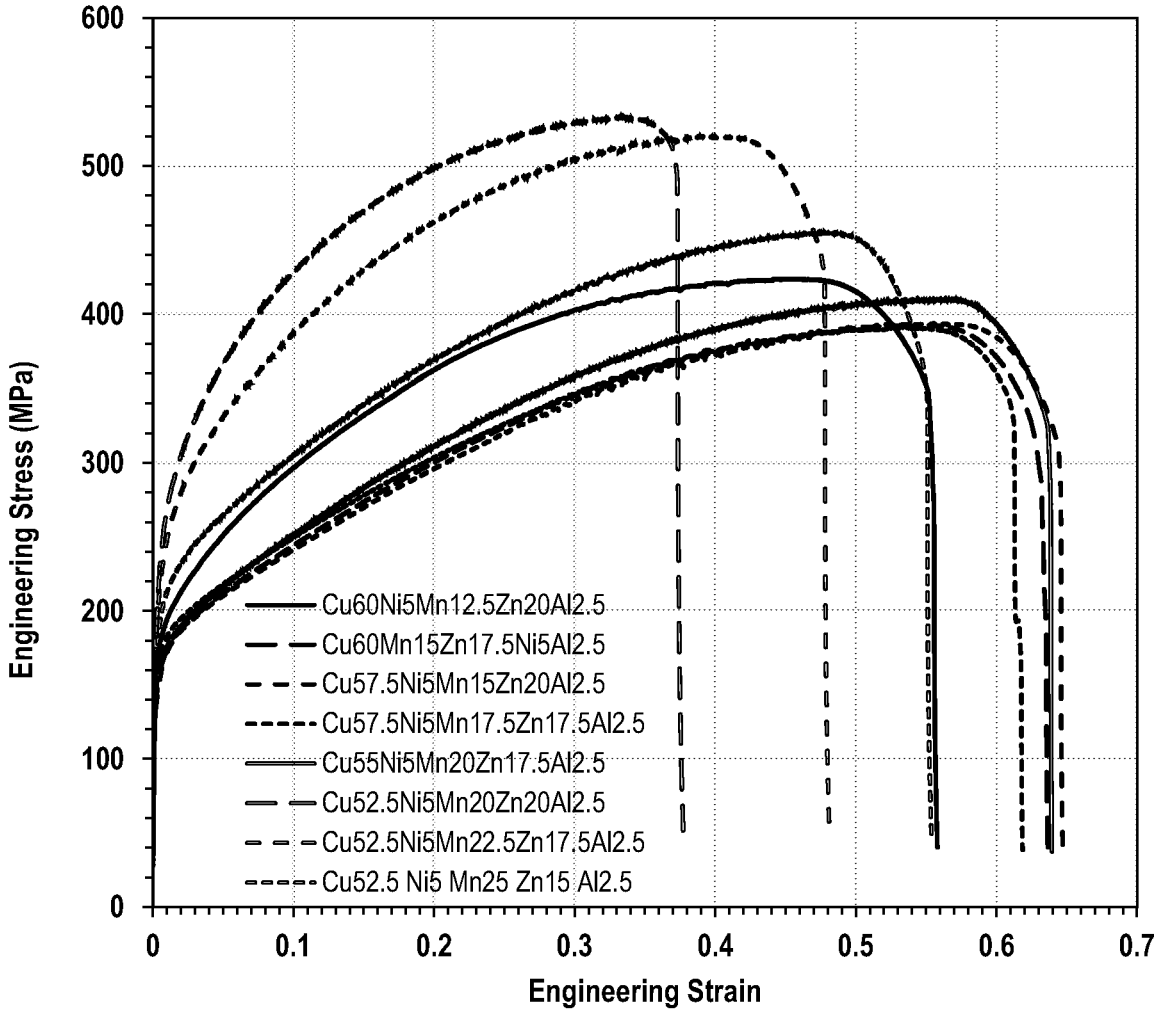
FIG. 1. Engineering stress/strain curves of alloy samples in tension.

The term "about" is understood to refer to a range of +/−10%, preferably +/−5% or +/−1% or, more preferably, +/−0.1%.

Throughout this specification, unless the context requires otherwise, the word "comprise", or variations such as "comprises" or "comprising" will be understood to imply the inclusion of a stated element, integer or step, or group of elements, integers or steps, but not the exclusion of any other element, integer or step, or group of elements, integers or steps. Thus, in the context of this specification, the term "comprising" means "including principally, but not necessarily solely".

Any numerical range recited herein is intended to include all sub-ranges of the same numerical precision subsumed within the recited range. For example, a range of 1.0 to 5.0 is intended to include all sub-ranges between (and including) the recited minimum value of 1.0 and the recited maximum value of 5.0, that is, having a minimum value equal to or greater than 1.0 and a maximum value equal to or less than 5.0, such as 2.1 to 4.5. Any maximum numerical limitation recited herein is intended to include all lower numerical limitations subsumed therein and any minimum numerical limitation recited herein is intended to include all higher numerical limitations subsumed therein.

The present disclosure provides alloys comprising or consisting of 40 to 62.5 atomic percent copper; 5 to 40 atomic percent manganese; up to 24 atomic percent nickel; 5 to 24 atomic percent zinc; and 1 to 15 atomic percent aluminium. It will be understood that the alloys described herein may comprise incidental impurities. Preferably, the incidental impurities do not exceed 0.5 at. %, or preferably, 0.1 at. %, or more preferably, 0.05 at. %.

In certain examples, the present disclosure provides an alloy comprising or consisting of: 42.5 to 65 at. % Cu; 10 to 40 at. % Mn; 0.5 to 8 at. % Ni; 5 to 24 at. % Zi; and 1 to 5 at. % Al. In certain examples, the present disclosure provides an alloy comprising or consisting of: 44 to 64 at. % Cu; 8 to 40 at. % Mn; 1 to 8 at. % Ni; 6 to 20 at. % Zi; and 1 to 4 at. % Al. In certain examples, the present disclosure provides an alloy comprising or consisting of: 42 to 62.5 at. % Cu; 8 to 40 at. % Mn; 1 to 8 at. % Ni; 6 to 20 at. % Zi; and 1 to 4 at. % Al. In certain examples, the present disclosure provides an alloy comprising or consisting of: 42.5 to 65 at. % Cu; 8 to 40 at. % Mn; 1 to 5 at. % Ni; 6 to 20 at. % Zi; and 1 to 3 at. % Al. In certain examples, the present disclosure provides an alloy comprising or consisting of: 47.5 to 62.5 at. % Cu; 8 to 40 at. % Mn; 1 to 6 at. % Ni; 6 to 15 at. % Zi; and 1 to 3 at. % Al. In certain examples, the present disclosure provides an alloy comprising or consisting of: 47.5 to 65 at. % Cu; 8 to 40 at. % Mn; 1 to 6 at. % Ni; 6 to 13 at. % Zi; and 1 to 3 at. % Al. In certain examples, the present disclosure provides an alloy comprising or consisting of: 45 to 60 at. % Cu; 12.5 to 35 at. % Mn; 3 to 5 at. % Ni; 12.5 to 20 at. % Zi; and 2 to 3 at. % Al.

In certain examples, the present disclosure provides an alloy consisting of: about 60 at. % Cu; about 5 at. % Ni; about 15 at. % Mn; about 17.5 at. % Zn; and about 2.5 at. % Al. The present disclosure also provides an alloy consisting of: about 60 at. % Cu; about 5 at. % Ni; about 12.5 at. % Mn; about 20 at. % Zn; and about 2.5 at. % Al. The present disclosure also provides an alloy consisting of: about 57.5 at. % Cu; about 5 at. % Ni; about 17.5 at. % Mn; about 17.5 at. % Zn; and about 2.5 at. % Al. The present disclosure also provides an alloy consisting of: about 57.5 at. % Cu; about 5 at. % Ni; about 15 at. % Mn; about 20 at. % Zn; and about 2.5 at. % Al. The present disclosure also provides an alloy consisting of: about 55 at. % Cu; about 5 at. % Ni; about 20 at. % Mn; about 17.5 at. % Zn; and about 2.5 at. % Al. The present disclosure also provides an alloy consisting of: about 55 at. % Cu; about 5 at. % Ni; about 17.5 at. % Mn; about 20 at. % Zn; and about 2.5 at. % Al. The present disclosure also provides an alloy consisting of: about 52.5 at. % Cu; about 5 at. % Ni; about 20 at. % Mn; about 20 at. % Zn; and about 2.5 at. % Al. The present disclosure also provides an alloy consisting of: about 52.5 at. % Cu; about 5 at. % Ni; about 22.5 at. % Mn; about 17.5 at. % Zn; and about 2.5 at. % Al. The present disclosure also provides an alloy consisting of: about 52.5 at. % Cu; about 5 at. % Ni; about 25 at. % Mn; about 15 at. % Zn; and about 2.5 at. % Al. The present disclosure also provides an alloy consisting of: about 52.5 at. % Cu; about 5 at. % Ni; about 27.5 at. % Mn; about 12.5 at. % Zn; and about 2.5 at. % Al. The present disclosure also provides an alloy consisting of: about 50 at. % Cu; about 5 at. % Ni; about 30 at. % Mn; about 12.5 at. % Zn; and about 2.5 at. % Al. The present disclosure also provides an alloy consisting of: about 50 at. % Cu; about 5 at. % Ni; about 27.5 at. % Mn; about 15 at. % Zn; and about 2.5 at. % Al. The present disclosure also provides an alloy consisting of: about 47.5 at. % Cu; about 5 at. % Ni; about 30 at. % Mn; about 15 at. % Zn; and about 2.5 at. % Al. The present disclosure also provides an alloy consisting of: about 47.5 at. % Cu; about 5 at. % Ni; about 32.5 at. % Mn; about 12.5 at. % Zn; and about 2.5 at. % Al. The present disclosure also provides an alloy consisting of: about 45 at. % Cu; about 5 at. % Ni; about 32.5 at. % Mn; about 15 at. % Zn; and about 2.5 at. % Al. The present disclosure also provides an alloy consisting of: about 45 at. % Cu; about 5 at. % Ni; about 35 at. % Mn; about 12.5 at. % Zn; and about 2.5 at. % Al. The present disclosure also provides an alloy consisting of: about 59 at. % Cu; about 3 at. % Ni; about 15.5 at. % Mn; about 20 at. % Zn; and about 2.5 at. % Al.

In some examples, the present disclosure provides an alloy comprising or consisting of: 5 to 40 at. % Mn; 1 to 24 at. % Ni; 5 to 24 at. % Zn; 1 to 15 at. % Al; and a balance of Cu. In some examples, the present disclosure provides an alloy comprising or consisting of: 8 to 40 at. % Mn; 1 to 8 at. % Ni; 5 to 24 at. % Zn; 1 to 15 at. % Al; and a balance of Cu. In some examples, the present disclosure provides an alloy comprising or consisting of: 8 to 40 at. % Mn; 1 to 8 at. % Ni; 5 to 24 at. % Zn; 1 to 5 at. % Al; a balance of Cu. In some examples, the present disclosure provides an alloy comprising or consisting of: 12.5 to 35 at. % Mn; 1 to 7 at. % Ni; 7.5 to 24 at. % Zn; 1 to 5 at. % Al; and a balance of Cu. In some examples, the present disclosure provides an alloy comprising or consisting of: 12.5 to 35 at. % Mn; 1 to 7 at. % Ni; 7.5 to 20 at. % Zn; 1 to 5% Al; and a balance of Cu. In some examples, the present disclosure provides an alloy comprising or consisting of: 22.5 to 35 at. % Mn; 1 to 5 at. % Ni; 7.5 to 12.5 at. % Zn; 1 to 3 at. % Al; and a balance of Cu. In some examples, the present disclosure provides an alloy comprising or consisting of: 17 to 35 at. % Mn; 1 to 8 at. % Ni; 9.5 to 20 at. % Zn; 0 to 5 at. % Al; and a balance of Cu. In some examples, the present disclosure provides an alloy comprising or consisting of: 17 to 35 at. % Mn; 1 to 8 at. % Ni; 9.5 to 20 at. % Zn; 1 to 5 at. % Al; and a balance of Cu. In some examples, the present disclosure provides an alloy comprising or consisting of: 17 to 35 at. % Mn; 1 to 8 at. % Ni; 9.5 to 15 at. % Zn; 1 to 5 at. % Al; and a balance of Cu. In some examples, the present disclosure provides an alloy comprising or consisting of: 17 to 35 at. % Mn; 1 to 8 at. % Ni; 9.5 to 12.5 at. % Zn; 1 to 5 at. % Al; and a balance of Cu. In some examples, the present disclosure provides an alloy comprising or consisting of: 17 to 35 at. % Mn; 1 to 8 at. % Ni; 9.5 to 12.5 at. % Zn; 1 to 3 at. % Al; and a balance of Cu. In some examples, the present disclosure provides an alloy comprising or consisting of: 17 to 35 at. % Mn; 1 to 5 at. % Ni; 9.5 to 12.5 at. % Zn; 1 to 3 at. % Al; and a balance of Cu.

In some examples, the present disclosure provides an alloy comprising or consisting of: 40 to 62.5 atomic percent copper; 5 to 40 atomic percent manganese; up to 24 atomic percent nickel; 5 to 24 atomic percent zinc; 1 to 15 atomic percent aluminium; and up to 20 atomic percent of one or more elements selected from the group consisting of chromium, lead, bismuth, cobalt, iron, carbon, tin, silicon and magnesium. In some examples, the present disclosure provides an alloy comprising or consisting of: 40 to 62.5 atomic percent copper; 5 to 40 atomic percent manganese; up to 24 atomic percent nickel; 5 to 24 atomic percent zinc; 1 to 15 atomic percent aluminium; and up to 1 atomic percent of one or more elements selected from the group consisting of arsenic, phosphorus, sulphur and antimony. In some examples, the present disclosure provides an alloy comprising or consisting of: 40 to 62.5 atomic percent copper; 5 to 40 atomic percent manganese; up to 24 atomic percent nickel; 5 to 24 atomic percent zinc; 1 to 15 atomic percent aluminium; up to 20 atomic percent of one or more elements selected from the group consisting of chromium, lead, bismuth, cobalt, iron, carbon, tin, silicon and magnesium; and up to 1 atomic percent of one or more elements selected from the group consisting of arsenic, phosphorus, sulphur and antimony. It will be understood that in such examples, the alloy may comprise one or more of chromium, lead, bismuth, cobalt, iron, carbon, tin, silicon and magnesium, as long as the total concentration of the one or more elements does not exceed 20 at. %. Likewise, such alloys may comprise one or more of arsenic, phosphorus, sulphur and antimony, as long as the total concentration of the one or more elements does not exceed more than 1 at. %. In certain examples, arsenic, phosphorus, sulphur and antimony are present in an amount of about 0.5 at. % individually or about 0.7 at. % in total.

In some examples, the present disclosure provides an alloy comprising or consisting of 40 to 62.5 at. % Cu; 5 to 40 at. % Mn; up to 24 at. % Ni; 5 to 24 at. % Zn; 1 to 15 at. % Al; and up to 20 at. % Cr. In some examples, the present disclosure provides an alloy comprising or consisting of 40 to 62.5 at. % Cu; 5 to 40 at. % Mn; up to 24 at. % Ni; 5 to 24 at. % Zn; 1 to 15 at. % Al; and up to 20 at. % Pb. In some examples, the present disclosure provides an alloy comprising or consisting of 40 to 62.5 at. % Cu; 5 to 40 at. % Mn; up to 24 at. % Ni; 5 to 24 at. % Zn; 1 to 15 at. % Al; and up to 20 at. % Bi. In some examples, the present disclosure provides an alloy comprising or consisting of 40 to 62.5 at. % Cu; 5 to 40 at. % Mn; up to 24 at. % Ni; 5 to 24 at. % Zn; 1 to 15 at. % Al; and up to 20 at. % Co. In some examples, the present disclosure provides an alloy comprising or consisting of 40 to 62.5 at. % Cu; 5 to 40 at. % Mn; up to 24 at. % Ni; 5 to 24 at. % Zn; 1 to 15 at. % Al; and up to 20 at. % Fe. In some examples, the present disclosure provides an alloy comprising or consisting of 40 to 62.5 at. % Cu; 5 to 40 at. % Mn; up to 24 at. % Ni; 5 to 24 at. % Zn; 1 to 15 at. % Al; and up to 20 at. % C. In some examples, the present disclosure provides an alloy comprising or consisting of 40 to 62.5 at. % Cu; 5 to 40 at. % Mn; up to 24 at. % Ni; 5 to 24 at. % Zn; 1 to 15 at. % Al; and up to 20 at. % Sn. In some examples, the present disclosure provides an alloy comprising or consisting of 40 to 62.5 at. % Cu; 5 to 40 at. % Mn; up to 24 at. % Ni; 5 to 24 at. % Zn; 1 to 15 at. % Al; and up to 20 at. % Si. In some examples, the present disclosure provides an alloy comprising or consisting of 40 to 62.5 at. % Cu; 5 to 40 at. % Mn; up to 24 at. % Ni; 5 to 24 at. % Zn; 1 to 15 at. % Al; and up to 20 at. % Mg.

In some examples, the alloy comprises 0 to 7 at. % chromium, such as 0 to 5 at. % chromium, 0.5 to 4.5 at. % chromium, 0.5 to 4 at. % chromium, 0.5 to 3.5 at. % chromium, 1 to 3.5 at. % chromium, 1 to 3 at. % chromium, 1.5 to 3 at. % chromium or 1.5 to 2.5 at. % chromium. For example, the alloy may comprise about 0.5 at. %, about 0.75 at. %, about 1 at. %, about 1.25 at. %, about 1.5 at. %, about 1.75 at. %, about 2 at. %, about 2.25 at. %, about 2.5 at. %, about 2.75 at. %, about 3 at. %, about 3.25 at. %, about 3.5 at. %, about 3.75 at. %, about 4 at. %, about 4.25 at. %, about 4.5 at. %, about 4.75 at. %, about 5 at. %, about 5.25 at. %, about 5.5 at. %, about 5.75 at. %, about 6 at. %, about 6.25 at. %, about 6.5 at. %, about 6.75 at. % or about 7 at. % chromium. In some examples, chromium is not present in the alloy (ie, 0 at. %). In some examples, the present disclosure provides an alloy comprising or consisting of 40 to 62.5 at. % Cu; 5 to 40 at. % Mn; up to 24 at. % Ni; 5 to 24 at. % Zn; 1 to 15 at. % Al; and 0 to 7 at. % Cr, such as 0.5 to 5 at. % Cr.

In some examples, the alloy comprises 0 to 8 at. % lead, such as 0 to 6 at. % lead, 0.5 to 5.5 at. % lead, 0.5 to 5 at. % lead, 0.5 to 4.5 at. % lead, 1 to 4.5 at. % lead, 1 to 4 at. % lead, 1.5 to 3.5 at. % lead or 1.5 to 3 at. % lead. For example, the alloy may comprise about 0.5 at. %, about 0.75 at. %, about 1 at. %, about 1.25 at. %, about 1.5 at. %, about 1.75 at. %, about 2 at. %, about 2.25 at. %, about 2.5 at. %, about 2.75 at. %, about 3 at. %, about 3.25 at. %, about 3.5 at. %, about 3.75 at. %, about 4 at. %, about 4.25 at. %, about 4.5 at. %, about 4.75 at. %, about 5 at. %, about 5.25 at. %, about 5.5 at. %, about 5.75 at. %, about 6 at. %, about 6.25 at. %, about 6.5 at. %, about 6.75 at. %, about 7 at. %, about 7.25 at. %, about 7.5 at. %, about 7.75 at. % or about 8 at. % lead. In some examples, lead is not present in the alloy (ie, 0 at. %). In some examples, the present disclosure provides an alloy comprising or consisting of 40 to 62.5 at. % Cu; 5 to 40 at. % Mn; up to 24 at. % Ni; 5 to 24 at. % Zn; 1 to 15 at. % Al; and 0 to 8 at. % Pb, such as 0.5 to 6 at. % Pb.

In some examples, the alloy comprises 0 to 8 at. % bismuth, such as 0 to 5 at. % bismuth, 0.5 to 4.5 at. % bismuth, 0.5 to 4 at. % bismuth, 0.5 to 3.5 at. % bismuth, 1 to 3 at. % bismuth, 1 to 2.5 at. % bismuth or 1.5 to 2.5 at. % bismuth. For example, the alloy may comprise about 0.5 at. %, about 0.75 at. %, about 1 at. %, about 1.25 at. %, about 1.5 at. %, about 1.75 at. %, about 2 at. %, about 2.25 at. %, about 2.5 at. %, about 2.75 at. %, about 3 at. %, about 3.25 at. %, about 3.5 at. %, about 3.75 at. %, about 4 at. %, about 4.25 at. %, about 4.5 at. %, about 4.75 at. %, about 5 at. %, about 5.25 at. %, about 5.5 at. %, about 5.75 at. %, about 6 at. %, about 6.25 at. %, about 6.5 at. %, about 6.75 at. %, about 7 at. %, about 7.25 at. %, about 7.5 at. %, about 7.75 at. % or about 8 at. % bismuth. In some examples, the alloy comprises less than 0.7 at. % bismuth such as less than 0.5 at. % bismuth. In some examples, bismuth is not present in the alloy (ie, 0 at. %). In some examples, the present disclosure provides an alloy comprising or consisting of 40 to 62.5 at. % Cu; 5 to 40 at. % Mn; up to 24 at. % Ni; 5 to 24 at. % Zn; 1 to 15 at. % Al; and 0 to 8 at. % Bi, such as 0.2 to 2 at. % Bi, such as about 0.55 at. % or about 0.6 at. % Bi.

In some examples, the alloy comprises 0 to 8 at. % cobalt, such as 0 to 6 at. % cobalt, 0.5 to 5.5 at. % cobalt, 0.5 to 5 at. % cobalt, 0.5 to 4.5 at. % cobalt, 1 to 4.5 at. % cobalt, 1 to 4 at. % cobalt, 1.5 to 3.5 at. % cobalt or 1.5 to 3 at. % cobalt. For example, the alloy may comprise about 0.5 at. %, about 0.75 at. %, about 1 at. %, about 1.25 at. %, about 1.5 at. %, about 1.75 at. %, about 2 at. %, about 2.25 at. %, about 2.5 at. %, about 2.75 at. %, about 3 at. %, about 3.25 at. %, about 3.5 at. %, about 3.75 at. %, about 4 at. %, about 4.25 at. %, about 4.5 at. %, about 4.75 at. %, about 5 at. %, about 5.25 at. %, about 5.5 at. %, about 5.75 at. %, about 6 at. %, about 6.25 at. %, about 6.5 at. %, about 6.75 at. %, about 7 at. %, about 7.25 at. %, about 7.5 at. %, about 7.75 at. % or about 8 at. % cobalt. In some examples, cobalt is not present in the alloy (ie, 0 at. %). In some examples, the present disclosure provides an alloy comprising or consisting of 40 to 62.5 at. % Cu; 5 to 40 at. % Mn; up to 24 at. % Ni; 5 to 24 at. % Zn; 1 to 15 at. % Al; and 0 to 8 at. % Co, such as 0.5 to 5 at. % Co.

In some examples, the alloy comprises 0 to 12 at. % iron, such as 0 to 10 at. % iron, 0.5 to 9 at. % iron, 0.5 to 8 at. % iron, 0.5 to 7 at. % iron, 1 to 6.5 at. % iron, 1 to 6 at. % iron, 1.5 to 5.5 at. % iron or 1.5 to 5 at. % iron. For example, the alloy may comprise about 0.5 at. %, about 0.75 at. %, about 1 at. %, about 1.25 at. %, about 1.5 at. %, about 1.75 at. %, about 2 at. %, about 2.25 at. %, about 2.5 at. %, about 2.75 at. %, about 3 at. %, about 3.25 at. %, about 3.5 at. %, about 3.75 at. %, about 4 at. %, about 4.25 at. %, about 4.5 at. %, about 4.75 at. %, about 5 at. %, about 5.25 at. %, about 5.5 at. %, about 5.75 at. %, about 6 at. %, about 6.25 at. %, about 6.5 at. %, about 6.75 at. %, about 7 at. %, about 7.25 at. %, about 7.5 at. %, about 7.75 at. %, about 8 at. %, about 8.25 at. %, about 8.5 at. %, about 8.75 at. %, about 9 at. %, about 9.25 at. %, about 9.5 at. %, about 9.75 at. %, about 10 at. %, about 10.25 at. %, about 10.5 at. %, about 10.75 at. %, about 11 at. %, about 11.25 at. %, about 11.5 at. %, about 11.75 at. % or about 12 at. % iron. In some examples, iron is not present in the alloy (ie, 0 at. %). In some examples, the present disclosure provides an alloy comprising or consisting of 40 to 62.5 at. % Cu; 5 to 40 at. % Mn; up to 24 at. % Ni; 5 to 24 at. % Zn; 1 to 15 at. % Al; and 0 to 12 at. % Fe, such as 0.5 to 7 at. % Fe.

In some examples, the alloy comprises 0 to 8 at. % carbon, such as 0 to 6 at. % carbon, 0.5 to 5.5 at. % carbon, 1 to 5 at. % carbon, 1.5 to 5 at. % carbon, 1.5 to 5 at. % carbon, 2 to 5 at. % carbon, 2.5 to 5 at. % carbon or 3 to 5 at. % carbon. For example, the alloy may comprise about 0.5 at. %, about 0.75 at. %, about 1 at. %, about 1.25 at. %, about 1.5 at. %, about 1.75 at. %, about 2 at. %, about 2.25 at. %, about 2.5 at. %, about 2.75 at. %, about 3 at. %, about 3.25 at. %, about 3.5 at. %, about 3.75 at. %, about 4 at. %, about 4.25 at. %, about 4.5 at. %, about 4.75 at. %, about 5 at. %, about 5.25 at. %, about 5.5 at. %, about 5.75 at. %, about 6 at. %, about 6.25 at. %, about 6.5 at. %, about 6.75 at. %, about 7 at. %, about 7.25 at. %, about 7.5 at. %, about 7.75 at. % or about 8 at. % carbon. In some examples, the alloy comprises less than 0.7 at. % carbon such as less than 0.5 at. % carbon. In some examples, carbon is not present in the alloy (ie, 0 at. %). In some examples, the present disclosure provides an alloy comprising or consisting of 40 to 62.5 at. % Cu; 5 to 40 at. % Mn; up to 24 at. % Ni; 5 to 24 at. % Zn; 1 to 15 at. % Al; and 0 to 8 at. % C, such as 0.5 to 5 at. % C.

In some examples, the alloy comprises 0 to 20 at. % tin, such as 0 to 10 at. % tin, 0.5 to 8 at. % tin, 0.5 to 4 at. % tin, 0.5 to 3.5 at. % tin, 1 to 3 at. % tin, 1 to 2.5 at. % tin or 1.5 to 2.5 at. % tin. For example, the alloy may comprise about 0.5 at. %, about 0.75 at. %, about 1 at. %, about 1.25 at. %, about 1.5 at. %, about 1.75 at. %, about 2 at. %, about 2.25 at. %, about 2.5 at. %, about 2.75 at. %, about 3 at. %, about 3.25 at. %, about 3.5 at. %, about 3.75 at. %, about 4 at. %, about 4.25 at. %, about 4.5 at. %, about 4.75 at. %, about 5 at. %, about 5.25 at. %, about 5.5 at. %, about 5.75 at. %, about 6 at. %, about 6.25 at. %, about 6.5 at. %, about 6.75 at. %, about 7 at. %, about 7.25 at. %, about 7.5 at. %, about 7.75 at. % or about 8 at. % tin. In some examples, tin is not present in the alloy (ie, 0 at. %). In some examples, the present disclosure provides an alloy comprising or consisting of 40 to 62.5 at. % Cu; 5 to 40 at. % Mn; up to 24 at. % Ni; 5 to 24 at. % Zn; 1 to 15 at. % Al; and 0 to 20 at. % Sn, such as 0.5 to 9 at. % Sn.

In some examples, the alloy comprises 0 to 8 at. % silicon, such as 0 to 6 at. % silicon, 0.5 to 5.5 at. % silicon, 0.5 to 5 at. % silicon, 0.5 to 4.5 at. % silicon, 1 to 4.5 at. % silicon, 1 to 4 at. % silicon, 1.5 to 3.5 at. % silicon or 1.5 to 3 at. % silicon. For example, the alloy may comprise about 0.5 at. %, about 0.75 at. %, about 1 at. %, about 1.25 at. %, about 1.5 at. %, about 1.75 at. %, about 2 at. %, about 2.25 at. %, about 2.5 at. %, about 2.75 at. %, about 3 at. %, about 3.25 at. %, about 3.5 at. %, about 3.75 at. %, about 4 at. %, about 4.25 at. %, about 4.5 at. %, about 4.75 at. %, about 5 at. %, about 5.25 at. %, about 5.5 at. %, about 5.75 at. %, about 6 at. %, about 6.25 at. %, about 6.5 at. %, about 6.75 at. %, about 7 at. %, about 7.25 at. %, about 7.5 at. %, about 7.75 at. % or about 8 at. % silicon. In some examples, silicon is not present in the alloy (ie, 0 at. %). In some examples, the present disclosure provides an alloy comprising or consisting of 40 to 62.5 at. % Cu; 5 to 40 at. % Mn; up to 24 at. % Ni; 5 to 24 at. % Zn; 1 to 15 at. % Al; and 0 to 8 at. % Si, such as 0.5 to 5 at. % Si.

In some examples, the alloy comprises 0 to 2 at. % magnesium, such as 0 to 1.75 at. % magnesium, 0.25 to 1.75 at. % magnesium, 0.25 to 1.5 at. % magnesium or 0.5 to 1.5 at. % magnesium. For example, the alloy may comprise about 0.25 at. %, about 0.5 at. %, about 0.75 at. %, about 1 at. %, about 1.25 at. %, about 1.5 at. %, about 1.75 at. % or about 2 at. % magnesium. In some examples, magnesium is not present in the alloy (ie, 0 at. %). In some examples, the present disclosure provides an alloy comprising or consisting of 40 to 62.5 at. % Cu; 5 to 40 at. % Mn; up to 24 at. % Ni; 5 to 24 at. % Zn; 1 to 15 at. % Al; and 0 to 2 at. % Mg, such as 0.2 to 1 at. % Mg.

In some examples, the alloys of the present disclosure comprise up to 1 atomic percent of one or more elements selected from the group consisting of arsenic, phosphorus, sulphur and antimony. For example, an alloy of the present disclosure may comprise about 0.1 at. %, about 0.2 at. %, about 0.3 at. %, about 0.4 at. %, about 0.5 at. %, about 0.6 at. %, about 0.7 at. %, about 0.8 at. %, about 0.9 at. % or about 1 at. % As. In some examples, the alloy may comprise about 0.1 at. %, about 0.2 at. %, about 0.3 at. %, about 0.4 at. %, about 0.5 at. %, about 0.6 at. %, about 0.7 at. %, about 0.8 at. %, about 0.9 at. % or about 1 at. % P. In some examples, the alloy may comprise about 0.1 at. %, about 0.2 at. %, about 0.3 at. %, about 0.4 at. %, about 0.5 at. %, about 0.6 at. %, about 0.7 at. %, about 0.8 at. %, about 0.9 at. % or about 1 at. % S. In some examples, the alloy may comprise about 0.1 at. %, about 0.2 at. %, about 0.3 at. %, about 0.4 at. %, about 0.5 at. %, about 0.6 at. %, about 0.7 at. %, about 0.8 at. %, about 0.9 at. % or about 1 at. % Sb.

In some examples, the present disclosure provides an alloy comprising or consisting of: 40 to 62.5 atomic percent copper; 5 to 40 atomic percent manganese; up to 24 atomic percent nickel; 5 to 24 atomic percent zinc; 1 to 15 atomic percent aluminium; and up to 0.5 atomic percent carbon or bismuth. In some examples, the present disclosure provides an alloy comprising or consisting of: 45 to 62.5 atomic percent copper; 8 to 40 atomic percent manganese; 1 to 8 atomic percent nickel; 5 to 24 atomic percent zinc; 1 to 5 atomic percent aluminium; up to 0.4 atomic percent carbon; and up to 0.4 atomic percent bismuth.

Manganese, zinc and aluminium generally reduce the stacking fault energy of a copper alloy. Of these three elements, aluminium is the most potent, reducing the stacking fault energy at a rate of about 3×Zn. Manganese provides a smaller decrease in stacking fault energy compared to zinc, generally about 0.2×Zn. The alloys of the present disclosure preferably comprise manganese, zinc and aluminium in amounts that confer a stacking fault energy similar to that conferred by 22.5 to 35 at. % zinc. In certain examples, the alloys of the present disclosure comprise aluminium, zinc and manganese in the following amounts:

(3×atomic percent of aluminium)+atomic percent of zinc+(0.2×atomic percent of manganese) is between 22.5% and 35%.

Or, expressed differently:

[(3×at. % Al)+(at. % Zi)+(0.2×at. % Mn)]=22.5 to 35 at. %.

In some examples, (3× atomic percent of aluminium)+atomic percent of zinc+(0.2× atomic percent of manganese) is between 22.5 at. % and 35 at. %, such as between 23.5 at. % and 32.5 at. %, between 24 at. % and 31 at. %, between 24.5 at. % and 30.5 at. %, between 25 at. % and 30 at. %, between 25.5 at. % and 29.5 at. %, between 26 at. % and 29.5 at. %, between 26.5 at. % and 29.5 at. %, or between 27 at. % and 29 at. %.

The ductility of a typical brass is largely a consequence of mechanical twinning within its microstructure. The ability of an alloy to twin is directly related to its stacking fault energy. An alloy with a low stacking fault energy generally twins more easily and is more ductile than an alloy with a high stacking fault energy. Increasing the nickel content of a copper alloy typically increases the alloy's stacking fault energy, thus increasing its strength but also decreasing its ductility. This can be less desirable for industry since the alloy requires more force to work it into shape. The alloys of the present disclosure preferably have more copper than nickel in atomic percent terms and are therefore more ductile and more easily worked compared to high-nickel alloys. For example, in the alloys of the present disclosure, the atomic percent ratio of copper:nickel may be at least 2, such as at least 3, or at least 4, at least 4.5, at least 5, at least 5.5, at least 6, at least 6.5, at least 7, at least 7.5, at least 8, at least 8.5, at least 9, at least 9.5, at least 10, at least 10.5, at least 11, at least 11.5, at least 12, at least 12.5, at least 13, at least 13.5, at least 14, at least 14.5, at least 15, at least 15.5, at least 16, at least 16.5, at least 17, at least 17.5, at least 18, at least 18.5, at least 19 or at least 19.5.

Copper is also known to be highly antimicrobial in a range or environments. Accordingly, the alloys of the present disclosure may be applied in situations where microbial resistance is desired. For example, the alloys described herein may be used in the manufacture of an autoclave, a door knob, cookware or a food container.

The alloys described herein are preferably low- or non-sparking, ie, they do not readily spark when they are struck mechanically, cut by metal tools or abraded/ground, thereby making them safe for use in volatile environments.

Although being present at lower levels compared to copper, the nickel in the present alloys may confer resistance to corrosion and increase the solubility of manganese and copper. Moreover, nickel may also hinder dezincification of the alloy in service. Dezincification occurs when zinc atoms migrate to grain boundaries and to the surface, enriching these areas locally with zinc and causing localised corrosion and weakness in the alloy.

Microstructurally, certain alloys of the present disclosure may be predominantly single phase (alpha/face-centred-cubic crystal structure) or multi-phase, depending on constitution and applied heat treatment.

Certain alloys described herein may be hardenable via a crystal structure ordering mechanism or spinodal decomposition event when heat treated for long periods of time at moderate temperatures.

In certain examples, an alloy of the present disclosure has a tensile strain to failure of between about 25% and 70%, such as between about 30% and 65%, or between about 31% and 64%, or between about 35% and 65%, or between about 40% and 65%, or between about 45% and 65%, or between about 45% and 60%, or between about 50% and 65%, or between about 55% and 65% or between about 60% and 65%.

In certain examples, the alloy of the present disclosure has an ultimate tensile strength of between about 350 MPa and 600 MPa, such as between about 360 MPa and 600 MPa, or between about 370 MPa and 600 MPa, or between about 380 MPa and 600 MPa, or between about 380 MPa and 590 MPa, or between about 385 MPa and 590 MPa, or between about 385 MPa and 585 MPa, or between about 390 MPa and 585 MPa, or between about 390 MPa and 580 MPa, or between about 390 MPa and 575 MPa, or between about 394 MPa and 572 MPa.

In some examples, the alloy of the present disclosure has an as-cast hardness ($H_V$) of between about 70 and 190, such as between about 75 and 180, or between about 80 and 170, or between about 86 and 90, or between about 83 and 89, or between about 111 and 114, or between about 94 and 103, or between about 135 and 137, or between about 111 and 116, or between about 133 and 137, or between about 111 and 116, or between about 133 and 137, or between about 142 and 166, or between about 120 and 126, or between about 120 and 150, or between about 125 and 155, or between about 130 and 160, or between about 130 and 165, or between about 105 and 127, or between about 122 and 139, or between about 129 and 139, or between about 150 and 166, or between about 130 and 137, or between about 135 and 150, or between about 130 and 140, or between about 94 and 103.

The alloys of the present disclosure may be cast or pressure die-cast into a final product (casting alloys) at relatively low temperatures, hot forged, hot-rolled or hot-extruded into a plate or rod/tube, cold-rolled or cold forged into a plate rod or tube, deep-drawn, turned, milled or machined with metal cutting tooling to specification. The alloys may be soldered, brazed or welded. The alloys may also be chrome- or nickel-plated.

The alloys of the present disclosure may be used in general building fixtures and hardware, including door and window hinges, latches, door knobs, door locks, knockers, keys, decorative fixtures, as well as mobile phone casings, bezels, badges and medals, ornamental castings and statues. The alloys may also be suitable for use in zippers, press studs for clothing or baggage/luggage, gears, cogs, gear drive shafts, solid slip bearings, munitions/cartridge or shell cases, ammunition, marine/ship applications, air liquid/liquid/liquid heating/cooling radiators, plumbing, currency, clamps, fasteners, nuts, bolts, screws, washers, acoustic devices such as speakers, resonators, tuning forks and musical instruments (eg, trumpet or trombone), electronic contacts, electrical conducting devices, circuitry electronic couplings, hydraulic or pneumatic fluid transfer tubing couplings or connectors (high or low pressure), hydraulic or pneumatic manifolds, switches, gates and non-sparking tooling (eg, for use in explosive environments).

EXAMPLES

Cu—Ni—Mn—Zn—Al alloy charge balances with a calculated final volume of 40 $cm^3$ were made from additions of near-pure copper, zinc and nickel. Manganese was added using a commercial 50/50 wt. % copper-manganese master alloy. Alloys were made in a two-step process:

1. Cu—Mn—Ni buttons were made in a Buhler electric arc melting furnace via cyclic melting of the copper and nickel balances with the copper-manganese master alloy. A titanium-gettered argon atmosphere was produced via purging of the melting chamber with high purity argon three times over and then evacuating using both roughing and turbo vacuum pumps to the order of $10^{-4}$ mbar. The melting chamber was then filled to 60% of atmospheric pressure with high purity argon. This was followed by melting a titanium getter. Homogeneity of the Cu—Ni—Mn buttons was obtained via first melting of the nickel shot in direct contact with copper (thus allowing the copper to melt into the molten nickel). Repeated melting of the newly formed Cu—Ni alloy followed by melting of the Cu—Ni buttons into the Cu—Mn master alloy produced homogenous Cu—Ni—Mn buttons.
2. Production of the final alloy and the inclusion of zinc and aluminium was conducted using an induction furnace. The zinc and aluminium were placed at the bottom of a boron nitride-coated graphite crucible with the Cu—Ni—Mn buttons placed on top to minimise zinc evaporation. Melting of the complete Cu—Ni—Mn—Zn—Al charge balances was conducted in a circulating argon-rich environment inside the induction furnace chamber. Complete charge balances were melted twice in the induction furnace; this was found to aid with homogeneity. During the first alloying cycle, charge balances were heated to 1100° C. where they were held for two minutes to ensure complete melting of all charge components. Alloyed ingots were then left to cool in the crucible before being removed and mechanically cleaned/abraded to a lustrous finish, removing any oxide products. Ingots were inverted and remelted in the induction furnace, again held at 1100° C. for two minutes, cooled to approximately 950° C., and the liquid metal poured (in air) into a 16 mm wide, 100 mm long, 50 mm deep copper mould.

Figure 2:
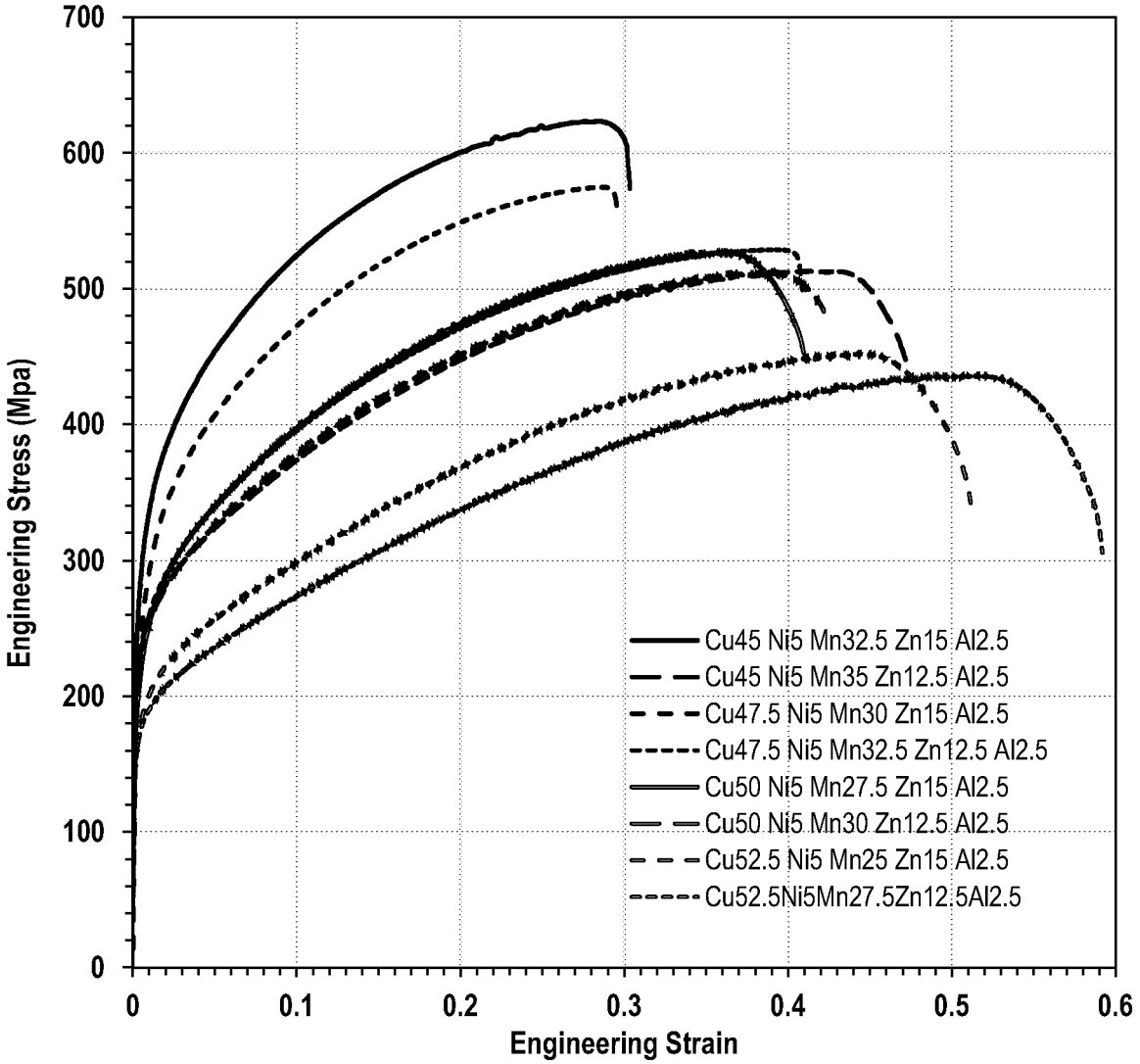
FIG. 2. Engineering stress/strain curves of alloy samples in tension.
Figure 3:
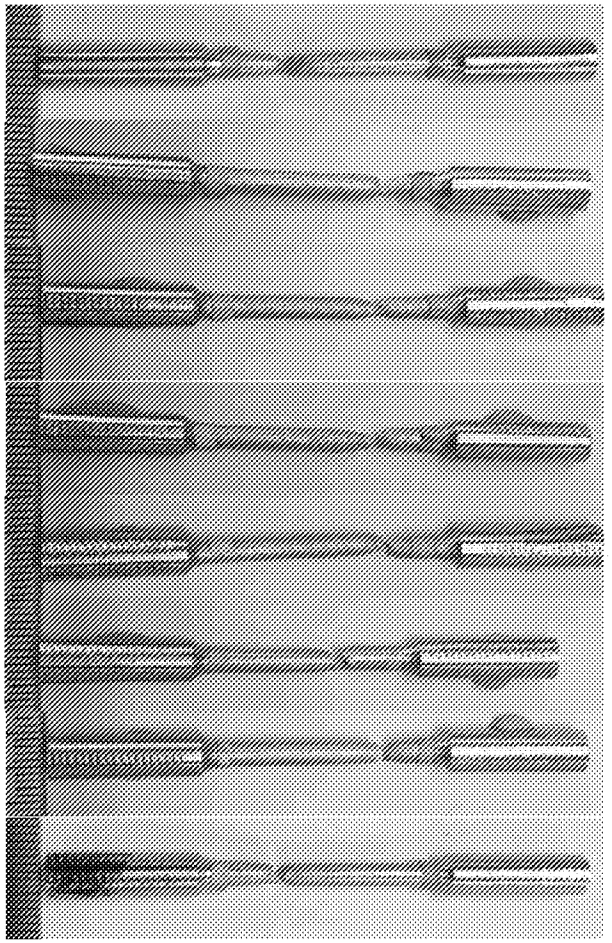
FIG. 3. Side profile of Cu—Ni—Mn—Zn—Al tensile specimen fractures. From left to right: $Cu_{60}Ni_5Mn_{15}Zn_{17.5}Al_{2.5}$, $Cu_{60}Ni_5Mn_{12.5}Zn_{20}Al_{2.5}$, $Cu_{57.5}Ni_5Mn_{17.5}Zn_{17.5}Al_{2.5}$, $Cu_{57.5}Ni_5Mn_{15}Zn_{20}Al_{2.5}$, $Cu_{55}Ni_5Mn_{20}Zn_{17.5}Al_{2.5}$, $Cu_{55}Ni_5Mn_{17.5}Zn_{20}Al_{2.5}$, $Cu_{52.5}Ni_5Mn_{22.5}Zn_{17.5}Al_{2.5}$, and $Cu_{52.5}Ni_5Mn_{20}Zn_{20}Al_{2.5}$.
Figure 4:
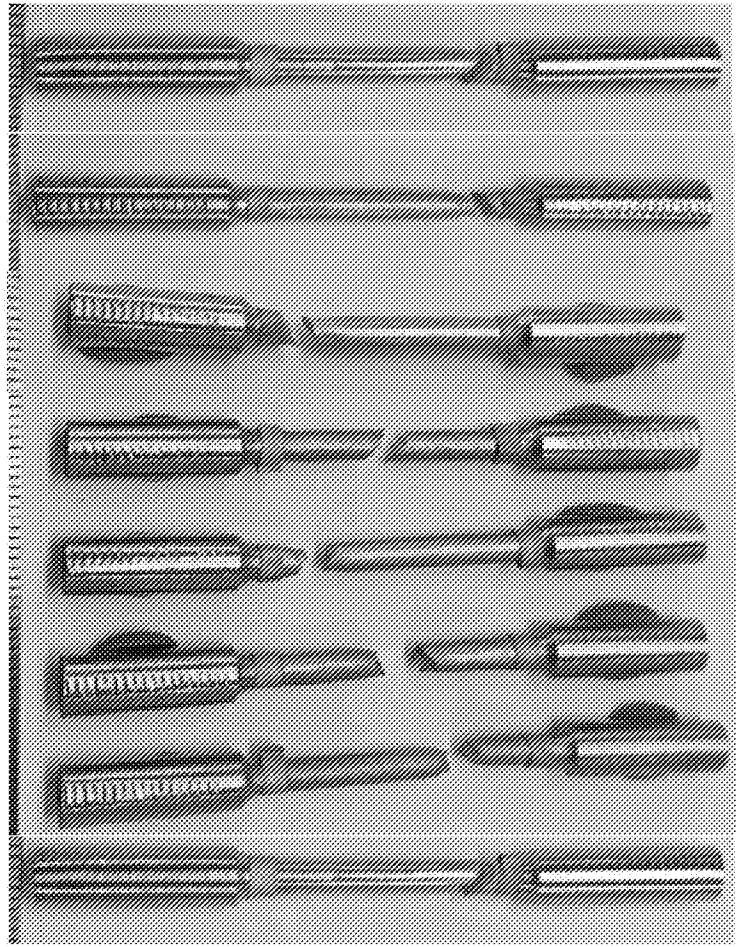
FIG. 4. Side profile of Cu—Ni—Mn—Zn—Al tensile specimen fractures. From left to right: $Cu_{45}Ni_5Mn_{32.5}Zn_{15}Al_{2.5}$, $Cu_{45}Ni_5Mn_{35}Zn_{12.5}Al_{2.5}$, $Cu_{47.5}Ni_5Mn_{30}Zn_{15}Al_{2.5}$, $Cu_{47.5}Ni_5Mn_{32.5}Zn_{12.5}Al_{2.5}$, $Cu_{50}Ni_5Mn_{27.5}Zn_{15}Al_{2.5}$, $Cu_{50}Ni_5Mn_{30}Zn_{12.5}Al_{2.5}$, $Cu_{52.5}Ni_5Mn_{27.5}Zn_{12.5}Al_{2.5}$, and $Cu_{52.5}Ni_5Mn_{25}Zn_{15}Al_{2.5}$.

The castings (100 mm×16 mm×35 mm) were sectioned into 50 mm×16 mm×35 mm blocks. One half of the casting was used for metallographic examination and hardness testing of the as-cast structure. The remaining half of the casting was processed via hot rolling and heat treatment. Initial heat treatment of the as-cast structures was conducted at 750° C. for two hours (with this heat treatment found to completely dissolve the as-cast microstructure in the Cu—Ni—Mn—Zn—Al alloys). Samples were then hot rolled at 750° C. in cross directions from a starting thickness of 16 mm down to 8 mm. The purpose of the hot rolling process was to close any casting pores or defects, consolidating the material, and to refine and recrystallise the grain structure, essentially reproducing industry processing. During the hot rolling process, samples were cyclically removed from a 750° C. furnace and rolled in 0.25 mm increments to their final thickness of 8 mm. Following the hot rolling process, samples received a final heat treatment of 750° C. for two hours to produce the final processed alloys in a hot rolled and annealed condition. At this stage, processed alloy billet had approximate dimensions of 8 mm×35 mm×90 mm. In order to produce tensile specimens from the processed alloy material, 8 mm×8 mm×62 mm strips were cut from the billet and machined into cylindrical tensile specimens with 4 mm gauge diameter and 20 mm gauge length in accordance with ASTM E8M. Tensile testing was conducted in accordance with ASTM A370 using an Instron tensile testing machine, laser extension meter and associated computer and data logger. Measured load and laser extension readings were recorded using software produced by Bluehill. Representative engineering stress-strain data are provided in FIGS. 1 and 2, and characteristic mechanical properties are set out in Table 1. Side profiles of alloys fractured under tension are shown in FIGS. 3 and 4.

Hardness testing was conducted on suitably prepared sections removed from the as-cast and processed samples. Hardness testing was conducted using a Struers duramen A300 hardness testing machine with a 1 kg load and a five second dwell time, following suitable calibration of the semiautomated machine on a 400 HV test block. Minimum 20 hardness indents were conducted for each sample.

TABLE 1

Compositions and characteristic mechanical properties of specific alloys (processed samples hot rolled at 750° C. and annealed at 750° C. for 2 hrs).

| | As-cast hardness ($HV_1$) | Processed alloy hardness ($HV_1$) | 0.2% Proof Stress (MPa) | Ultimate Tensile Strength (MPa) | Tensile Elongation to Failure (Strain %) |
|---|---|---|---|---|---|
| $Cu_{60}Ni_5Mn_{15}Zn_{17.5}Al_{2.5}$ | 86-90 | 139-153 | 210 | 495 | 42 |
| $Cu_{60}Ni_5Mn_{12.5}Zn_{20}Al_{2.5}$ | 83-89 | 96-100 | 169 | 424 | 56 |
| $Cu_{57.5}Ni_5Mn_{17.5}Zn_{17.5}Al_{2.5}$ | 111-114 | 85-99 | 165 | 413 | 61 |
| $Cu_{57.5}Ni_5Mn_{15}Zn_{20}Al_{2.5}$ | 94-103 | 81-92 | 160 | 394 | 64 |
| $Cu_{55}Ni_5Mn_{20}Zn_{17.5}Al_{2.5}$ | 135-137 | 117-127 | 229 | 533 | 38 |
| $Cu_{55}Ni_5Mn_{17.5}Zn_{20}Al_{2.5}$ | 111-116 | 100-108 | 175 | 409 | 63 |
| $Cu_{52.5}Ni_5Mn_{20}Zn_{20}Al_{2.5}$ | 133-137 | 122-128 | 225 | 520 | 39 |
| $Cu_{52.5}Ni_5Mn_{22.5}Zn_{17.5}Al_{2.5}$ | 142-166 | 116-123 | 208 | 520 | 48 |
| $Cu_{52.5}Ni_5Mn_{25}Zn_{15}Al_{2.5}$ | 120-126 | 110-132 | 174 | 455 | 55 |
| $Cu_{52.5}Ni_5Mn_{27.5}Zn_{12.5}Al_{2.5}$ | 105-127 | 97-110 | 165 | 458 | 59 |
| $Cu_{50}Ni_5Mn_{30}Zn_{12.5}Al_{2.5}$ | 122-139 | 115-124 | 190 | 519 | 42 |
| $Cu_{50}Ni_5Mn_{27.5}Zn_{15}Al_{2.5}$ | 129-139 | 119-141 | 192 | 527 | 41 |
| $Cu_{47.5}Ni_5Mn_{30}Zn_{15}Al_{2.5}$ | 150-166 | 150-159 | 217 | 572 | 31 |
| $Cu_{47.5}Ni_5Mn_{32.5}Zn_{12.5}Al_{2.5}$ | 130-137 | 134-142 | 189 | 536 | 41 |

TABLE 1-continued

Compositions and characteristic mechanical properties of specific alloys (processed samples hot rolled at 750° C. and annealed at 750° C. for 2 hrs).

| | As-cast hardness ($HV_1$) | Processed alloy hardness ($HV_1$) | 0.2% Proof Stress (MPa) | Ultimate Tensile Strength (MPa) | Tensile Elongation to Failure (Strain %) |
|---|---|---|---|---|---|
| $Cu_{45}Ni_5Mn_{32.5}Zn_{15}Al_{2.5}$ | 135-150 | 137-144 | 253 | 629 | 29 |
| $Cu_{45}Ni_5Mn_{35}Zn_{12.5}Al_{2.5}$ | 130-140 | 111-117 | 191 | 519 | 47 |
| $Cu_{59}Ni_3Mn_{15.5}Zn_{20}Al_{2.5}$ | 94-103 | 85-95 | 155 | 390 | 64 |

While the techniques described above in this example may be suitable for laboratory scale alloy production, those skilled in the art will understand that other methods may be used, particularly for industrial scale alloy production. For example, the alloys may be produced by large scale melting of all alloy constituents in an induction or resistance heated furnace until completely molten. This may include alloying higher melting-point constituents first while progressively lowering the melt temperature as lower melting-point constituents are added to avoid off-gassing of zinc and/or manganese. Additives, fluxes or coke may be used to reduce oxygen, hydrogen and other impurities in the melt and to protect the melt surface from further oxidation or degradation. The melt may then be cast as ingots. The ingots may then be cast or pressure die-cast directly into products. The alloy could also be continuously cast through a water-cooled graphite or copper or other metal nozzle in a fixed cross section to produce plate, bar, rod or hollow-section products. Alternatively, the melt may be twin-roll strip cast into sheet products. Products may be subsequently homogenised at temperatures above 700° C., hot rolled, hot-extruded, hot-drawn or forged to their required shape at temperatures above 600° C. Products may be cold-worked (rolled, extruded, forged or drawn) and tempered or hardened by low-temperature annealing.

Although the invention has been described with reference to specific embodiments, it will be appreciated by those skilled in the art that the invention may be embodied in many other forms.

The invention claimed is:

1. An alloy consisting of:

about 60 to greater than about 50 atomic percent copper;

about 15 to about 35 atomic percent manganese;

about 1 to about 7 atomic percent nickel;

about 7.5 to about 20 atomic percent zinc;

about 1 to about 5 atomic percent aluminium; and incidental impurities wherein (3× atomic percent of aluminium)+atomic percent of zinc+(0.2× atomic percent of manganese) is between about 23.5% and about 32.5%;

and wherein the alloy has ultimate strain of about 40-65%.

2. The alloy of claim 1 having about 15 to about 22.5 atomic percent manganese.

3. The alloy of claim 1 having about 15 to about 18.5 atomic percent manganese.

4. The alloy of claim 1 having about 17.5 to about 18.5 atomic percent manganese.

5. The alloy of claim 1 having about 1 to about 5 atomic percent nickel.

6. The alloy of claim 1 having about 15 to about 20 atomic percent zinc.

7. The alloy of claim 1 having about 1 to about 3 atomic percent aluminium.

8. The alloy of claim 1 having about 2 to about 3 atomic percent aluminium.

9. The alloy of claim 1 which is $Cu_{57.5}Ni_5Mn_{17.5}Zn_{17.5}Al_{2.5}$ or $Cu_{55}Ni_5Mn_{17.5}Zn_{20}Al_{2.5}$.

10. The alloy of claim 1 having about 24.5 to about 35 atomic percent manganese.

11. The alloy of claim 10 having about 55 to greater than about 50 atomic percent copper.

12. The alloy of claim 10 having about 15 to about 20 atomic percent zinc.

13. The alloy of claim 10 having about 1 to about 3 atomic percent aluminium.

14. The alloy of claim 10 having about 2 to about 3 atomic percent aluminium.

15. The alloy of claim 10 which is $Cu_{52.5}Ni_5Mn_{25}Zn_{15}Al_{2.5}$, $Cu_{52.5}Ni_5Mn_{27.5}Zn_{12.5}Al_{2.5}$, $Cu_{50}Ni_5Mn_{30}Zn_{12.5}Al_{2.5}$, $Cu_{50}Ni_5Mn_{27.5}Zn_{15}Al_{2.5}$, $Cu_{47.5}Ni_5Mn_{30}Zn_{15}Al_{2.5}$, $Cu_{47.5}Ni_5Mn_{32.5}Zn_{12.5}Al_{2.5}$, $Cu_{45}Ni_5Mn_{32.5}Zn_{15}Al_{2.5}$, or $Cu_{45}Ni_5Mn_{35}Zn_{12.5}Al_{2.5}$.

16. The alloy of claim 1 which is $Cu_{57.5}Ni_5Mn_{15}Zn_{20}Al_{2.5}$ or $Cu_{59}Ni_3Mn_{15.5}Zn_{20}Al_{2.5}$.

17. The alloy of claim 1 having an ultimate tensile strength of between about 350 MPa and about 600 MPa.

* * * * *